US005201124A

United States Patent [19]

Sherman

[11] Patent Number: 5,201,124

[45] Date of Patent: Apr. 13, 1993

[54] ILLUMINATED ARCHERY SIGHT PIN

[76] Inventor: James R. Sherman, 2961 Rudo Rd., Orofina, Id. 83544

[21] Appl. No.: 827,145

[22] Filed: Jan. 28, 1992

[51] Int. Cl.[5] ..... F41G 1/46; F41G 1/32

[52] U.S. Cl. ..... 33/265; 33/241

[58] Field of Search ..... 33/265, 241, 242; 124/87

[56] References Cited

U.S. PATENT DOCUMENTS

| | | | |
|---|---|---|---|
| 802,277 | 10/1905 | Fric | 33/241 |
| 3,184,851 | 5/1965 | Simmons | 33/241 |
| 3,945,127 | 3/1976 | Spencer . | |
| 4,177,572 | 12/1979 | Hindes | 33/265 |
| 4,220,983 | 9/1980 | Schroeder | 362/114 |
| 4,309,827 | 1/1982 | Larson . | |
| 4,928,394 | 5/1990 | Sherman | 33/265 |
| 4,977,677 | 12/1990 | Troescher, Jr. . | |

*Primary Examiner*—Harry N. Haroian
*Attorney, Agent, or Firm*—James D. Givnan, Jr.

[57] ABSTRACT

A sight is shown on an archery bow with the sight formed from a light collecting and conducting plastic. A bead of the sight is formed by a face located on end segment at one end of an elongate, tapered main member. The main member has a relatively large, light collecting surface area to assure bead illumination in low light conditions. The light waves collected by the main member are internally conducted by the sight formed from a transparent plastic with a fluorescent dye dispersed therein. One form of sight utilizes mechanical components for attachment to a bow while a modified form forms such components from the plastic material.

4 Claims, 1 Drawing Sheet

ILLUMINATED ARCHERY SIGHT PIN

BACKGROUND OF THE INVENTION

The present invention pertains generally to illuminated archery and gun sights and in particular to such a sight having light collecting capabilities.

In low light conditions, as in the early morning or late afternoon, the sighting of an archery bow on a target is rendered difficult by reduced demarcation between sight and target. Illuminated sights are found in the prior art with certain of the prior art sights utilizing an artificial light source such as a battery illuminated bulb or diode while other illuminated sights have relied upon the collection of natural light conducted to the bead of a sight pin as in the illuminated sight disclosed in the present inventor's earlier issued U.S. Pat. No. 4,928,394. In such a sight ambient light is collected at a point remote from that end of a light transmitting fiber optic constituting a bead of the sight. The fiber optic being rooted through a tubular pin termed a sight pin. A number of such sight pins are adjustably mounted on a bracket with each sight pin associated with a target distance.

U.S. Pat. No. 4,220,983 utilizes a light-emitting diode disposed within a ring and served by conductors and a battery source. U.S. Pat. No. 4,977,677 utilizes a battery powered diode to illuminate the reticle of a sight within a ring.

The utilization of artificial power sources for hunting sights is now banned by several states, thus excluding in those states sights utilizing a battery. Accordingly it becomes desirable that the sight pin or pins have excellent light absorbing or collecting characteristics as well as light transmitting and re-emitting capabilities to provide a large proportion of the light collected to a properly illuminated sight bead. Accordingly it is desirable that the sight pin be able to collect adequate light and to transmit same to a bead of reduced size so that the associated sight structure does not interfere with the sight picture presented the shooter. A further objective is a sight particularly for use on hunting bows that can withstand accidental contact with twigs and branches.

SUMMARY OF THE PRESENT INVENTION

The present invention is embodied within a sight pin having angularly related segments with one of said segments terminating in a face constituting a bead.

The present sight pin is formed from a light collecting material which additionally conducts or transmits the light to a surface which, in the present instance, constitutes a bead of the sight. A segment of the present sight is of tapered configuration for purposes of strength and adapted for attachment to a mounting plate of an archery bow. Alternatively the sight pin may be machined to permit direct attachment to a bow mounted mounting plate. The end segment of the sight pin having a planar surface constituting a bead is of lesser length than the angularly oriented elongate member of the sight. The reduced or cross section of the bead bearing segment of the sight precludes obscuring of the target.

Important objectives of the present invention include the provision of a sight pin of light collecting characteristics and having an angularly disposed segment of truncated shape with an illuminated bead surface thereon; a provision of an illuminated sight pin of light collecting material of tapered configuration; the provision of an illuminated sight pin adapted for attachment to a mounting plate by means of an intermediate non-light collecting member; the provision of a sight pin which is of tapered configuration and having a relatively large light collecting surface area for optimum collection of light for conduction to a bead of reduced diameter to avoid obscuring the target.

DETAILED DESCRIPTION OF THE PREFERRED EMBODIMENTS

Figure 1:
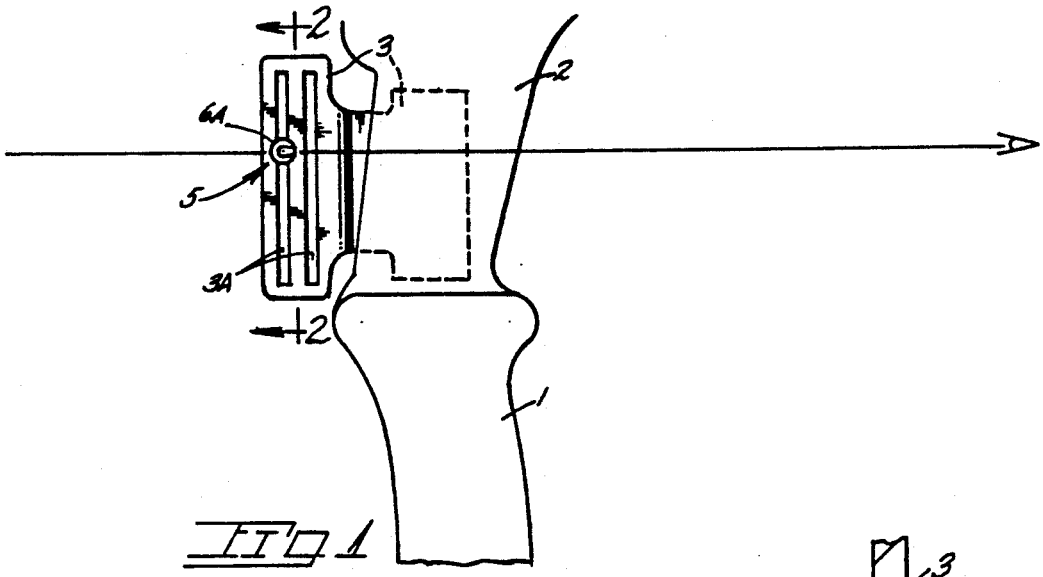
FIG. 1 is a fragmentary side elevational view of an archery bow handle and riser with the present sight in place thereon.
Figure 2:
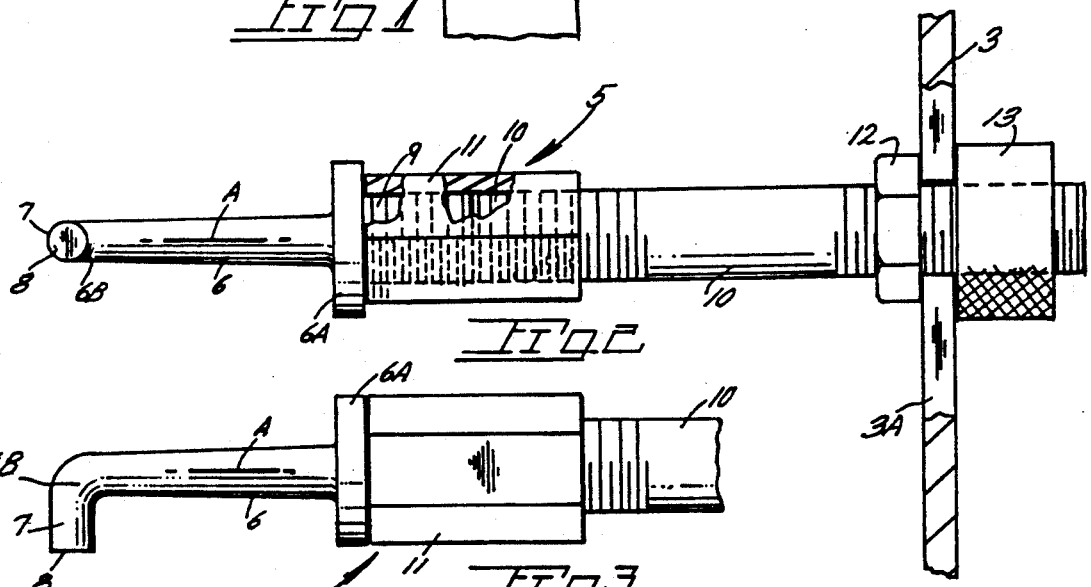
FIG. 2 is an enlarged vertical sectional view taken along line 2—2 of FIG. 1.
Figure 3:
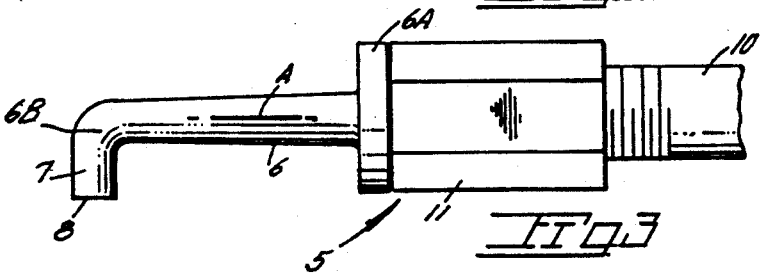
FIG. 3 is a plan view of a fragment of the sight structure shown in FIG. 2.

With continuing attention to the drawings wherein applied reference numerals indicate parts similarly hereinafter identified, the reference numeral 1 indicates the hand grip of an archery bow. A riser 2 of the archer bow extends upwardly from hand grip 1 and serves, in typical fashion, to provide a surface to which may be attached a sight. For purposes of attaching the present, illuminated sight pin to the bow, a mounting plate 3 is provided and may be of the type having multiple upright slots 3A for the reception of vertically adjustable sight pins to provide different beads for different target ranges. While only one sight pin is shown, multiple vertically spaced sight pins may be utilized on plate 3.

With attention now to the present sight pin indicated generally at 5, the same includes a major member or segment 6 of elongate tapered configuration. Major segment 6 terminates at its proximal end in a threaded segment 9 with a flange 6A. At its remaining end segment 6 merges with a curved segment 6B which, in turn, merges with an end segment 7 which terminates in a face 8. The material utilized for the present sight, as elaborated on below, results in a large proportion of the collected light being emitted at an edge surface as at face 8 which constitutes a bead of the sight pin. As the surface area of face or bead 8 is relatively small in proportion to the surface area of elongate, tapered major segment 6 and curved segment 7, the bead surface will be well illuminated even in low light conditions. Bead 8 is offset from a vertical plane containing the major axis at A of major member 6. A suitable plastic is that sold under the trademark LISA.

For purposes of attaching the sight pin to mounting plate 3, a threaded shaft 10 may be utilized with one end of the shaft in threaded engagement with a coupler 11 which additionally receives end segment 9 of the sight pin. A jam nut 12 serves to clamp the shaft 10 to plate 3 in conjunction with a knurled finger nut 13.

Figure 4:
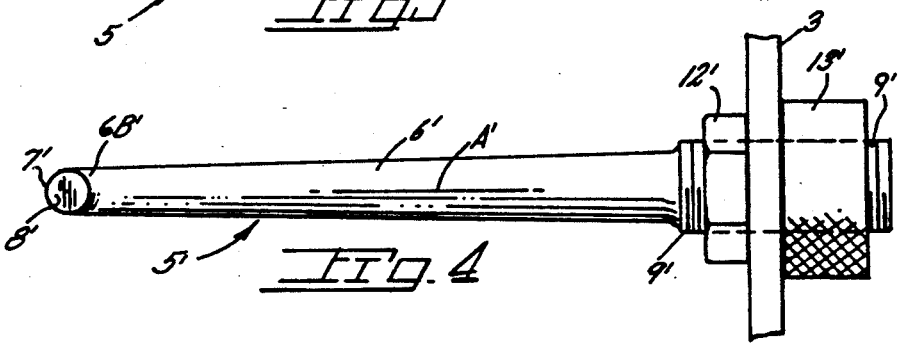
FIG. 4 shows a plain view of modified form of sight pin.

A modified form of the present sight pin shown in FIG. 4 is of unitary construction and dispenses with flange 6A and provides a major elongate member or segment 6' of extended length terminating in an integral threaded segment 9' for direct attachment to a sight mounting plate 3' by means of nut elements 12' and 13'. A face 8' provides an illuminated bead. The modified form of sight pin provides a greater ratio of light collecting surface area to the surface area of 8' than the first described form of the sight to further enhance bead illumination. The tapered shape of both elongate segments 6 and 6' provides a degree of flexibility to the sight pins to resist fracturing upon impact.

In one suitable embodiment of the first described sight pin the major member or segment 6 is of a length of 0.325 inch tapering downwardly to a diameter of 0.055 inch. The remaining portion of major segment 6 maintains the above noted diameter for a length of 0.050 inch whereat it merges with curved segment 6B having an outside radius of 0.0825 inch. Minor or end segment 7 of the pin is of a length of 0.050 inch and terminates in a face 8 of a diameter of 0.055 inch with the end segment supported by the curved segment. The distal portion of the sight pin when formed as above described assures efficient conduction of the light waves to face 8 of the pin while avoiding obscuring the target.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A sight having a bead illuminated by ambient light, said sight comprising, a light wave collecting and conducting member having a major segment of elongate tapered configuration having a light absorbing surface for exposure to direct ambient daylight, a remaining portion of said major segment of uniform diameter, said member additionally including a curved segment and an end segment terminating in a face constituting said bead, said curved segment and said end segment being of uniform diameter and extend from end of said tapered segment, said member of a transparent plastic having a fluorescent dye dispersed therein, and means for coupling said member to a support.

2. The invention claimed in claim 1 wherein said means for coupling said member to a support includes a threaded shaft, a coupling on said shaft coupling said shaft to said member.

3. The invention claimed in claim 1 wherein said means for coupling said member to a support includes a threaded segment on said member.

4. The sight claimed in claim 1 wherein said light wave collecting and conducting member is of a transparent plastic material and of a flexible nature.

* * * * *